US007351935B2

(12) United States Patent
Konishi

(10) Patent No.: US 7,351,935 B2
(45) Date of Patent: Apr. 1, 2008

(54) METHOD FOR PRODUCING A CERAMIC HEATER, CERAMIC HEATER PRODUCED BY THE PRODUCTION METHOD, AND GLOW PLUG COMPRISING THE CERAMIC HEATER

(75) Inventor: Masahiro Konishi, Kariya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 11/157,949

(22) Filed: Jun. 22, 2005

(65) Prior Publication Data

US 2005/0284859 A1 Dec. 29, 2005

(30) Foreign Application Priority Data

Jun. 25, 2004 (JP) ..... P. 2004-188839

(51) Int. Cl.
*F23Q 7/22* (2006.01)

(52) U.S. Cl. ..... 219/270; 219/541; 219/544; 123/145 R; 123/145 A; 29/611

(58) Field of Classification Search ..... 219/270, 219/541, 544; 123/145 R; 29/611; 122/145 A
See application file for complete search history.

(56) References Cited

U.S. PATENT DOCUMENTS 4,449,039 A * 5/1984 Fukazawa et al. ..... 219/553
4,806,734 A * 2/1989 Masaka et al. ..... 219/270
4,874,923 A * 10/1989 Hatanaka et al. ..... 219/270
4,914,274 A * 4/1990 Hatanaka et al. ..... 219/270
4,914,751 A * 4/1990 Masaka et al. ..... 219/270
5,059,768 A * 10/1991 Hatanaka et al. ..... 219/270
5,084,607 A * 1/1992 Shafer et al. ..... 219/270
5,519,187 A * 5/1996 Hinkle ..... 219/270
5,756,215 A * 5/1998 Sawamura et al. ..... 428/446
6,326,595 B2 * 12/2001 Taniguchi et al. ..... 219/270
6,844,525 B2 * 1/2005 Yoshikawa et al. ..... 219/270
6,933,471 B2 * 8/2005 Hamel et al. ..... 219/270
2002/0144990 A1 * 10/2002 Haussner et al. ..... 219/270
2002/0148823 A1 * 10/2002 Watanabe et al. ..... 219/270
2002/0162830 A1 * 11/2002 Taniguchi et al. ..... 219/270
2002/0162831 A1 * 11/2002 Taniguchi et al. ..... 219/270
2002/0175156 A1 * 11/2002 Hotta et al. ..... 219/270
2003/0029856 A1 * 2/2003 Tatematsu et al. ..... 219/270
2003/0126736 A1 * 7/2003 Watanabe et al. ..... 29/611
2004/0262282 A1 * 12/2004 Yoshikawa et al. ..... 219/270

FOREIGN PATENT DOCUMENTS

EP 1 434 005 A2 6/2004
JP 02251013 A * 10/1990
JP 405266967 A * 10/1993
JP 2002-364842 12/2002
JP 2003025195 A * 1/2003

* cited by examiner

*Primary Examiner*—Quang Van
*Assistant Examiner*—Stephen J. Ralis
(74) *Attorney, Agent, or Firm*—Sughrue Mion, PLLC

(57) ABSTRACT

A method for producing a ceramic heater. Firing is conducted such that an element green body in which at least a portion containing a conductive ceramic that is to become a heating element after firing is held on a powder or green body of an insulating ceramic that is to become a substrate after firing. The ceramic heater includes the substrate and the heating element. The method includes a molding step, a holding step, and a firing step as defined herein.

11 Claims, 12 Drawing Sheets

METHOD FOR PRODUCING A CERAMIC HEATER, CERAMIC HEATER PRODUCED BY THE PRODUCTION METHOD, AND GLOW PLUG COMPRISING THE CERAMIC HEATER

BACKGROUND OF THE INVENTION

1. Field of the Invention

The present invention relates to a method for producing a ceramic heater in which a conductive heating resistor is held on a substrate containing an insulating ceramic, a ceramic heater produced by the production method, and a glow plug comprising the ceramic heater.

2. Description of the Related Art

Conventionally, a glow plug used for assisting start of a diesel engine is configured by: a rod-like heater housing a heating element which generates heat when energized; a cylindrical member which surrounds and holds the heater such that a main heat generating portion of the heater protrudes from the tip end; a cylindrical metal shell which holds the outer circumference of the cylindrical member so that the tip end of the heater protrudes; and the like. In a ceramic heater, particularly, both electrodes or a cathode and an anode for applying a voltage to a heating resistor of a heating element are disposed on the rear end side. One of the electrodes is electrically connected to a metal shell, and the other electrode is electrically connected to a center pole which is insulated and held on the rear end side of the metal shell.

Recently, as this type of heater, a ceramic heater has been used in which a heating element is held on a substrate made of a ceramic that has excellent corrosion resistance. Such a ceramic heater is usually formed in the following manner. First, a planar body made of an insulating ceramic is formed by injection molding. Next, a heating element is sandwiched in the planar body, and the whole body is subjected to a pressing process so as to be integrally molded. A debinding process is conducted on the molded body, and the molded body is then fired. The outer circumference is polished so as to be shaped, whereby the ceramic heater is completed.

A conductive ceramic in a heating element has been proposed for use in such a ceramic heater. The ceramic-made heating element can also be formed by injection molding in the same manner as the substrate. For example, JP-A-2002-364842 discloses a configuration in which a heating resistor (resistance heater) that mainly generates heat, and two lead portions connected respectively to both electrodes of the heating resistor extending to the outside of a ceramic heater are integrally produced into a U-like shape.

3. Problems to be Solved by the Invention

Before the firing process, however, the ceramic-made heating element is in a state where a ceramic powder is compressed and packed (hereinafter, an element in such state is also referred to as an "element green body"), and hence is brittle. Particularly, a portion which is to become the heating resistor after the firing process supports the two lead portions after the firing process, and therefore a load due to the weight of the lead portions is applied to the portion which is to become the heating resistor. When the heating element is handled carelessly in the production process of a ceramic heater, consequently, there is a possibility of damage to the heating element.

SUMMARY OF THE INVENTION

The invention has been made in order to solve the above-described problem. It is therefore an object of the invention to provide a method for producing a ceramic heater which enhances the mechanical strength of an element green body, and promotes ease of handling of the element green body during production of the ceramic heater, a ceramic heater produced by the production method, and a glow plug comprising the ceramic heater.

(1) The above object of the invention has been achieved by providing a method for producing a ceramic heater in which firing is conducted in a state where an element green body in which at least a portion containing a conductive ceramic that is to become a heating element after firing is held on a powder or green body of an insulating ceramic that is to become a substrate after firing, thereby producing the ceramic heater including the substrate and the heating element. The method comprises: a molding step of forming an element green body having an annular portion; a holding step of holding the element green body by the powder or green body of an insulating ceramic, to form an element holding body; and a firing step of firing the element holding body to form a fired body so that a first part of said annular portion becomes said heating element.

(2) In a preferred embodiment of the method for producing a ceramic heater as described in (1) above, in the molding step, the element green body including the first part is formed from a powder of a conductive ceramic by injection molding, and the method further comprises an opening step of, after the holding step, cutting or grinding a second part of the annular portion so that the heating element remains.

(3) In yet another preferred embodiment, in the method for producing a ceramic heater as described in (1) above, the ceramic heater has a rod-like shape (rod-shaped ceramic heater). In the molding step, the element green body having an annular portion comprises: two lead portions arranged along a longitudinal direction of the ceramic heater; a heating portion which connects one-end sides of the lead portions together; and a connecting portion which connects the lead portions together on a side of other ends with respect to the heating portion. In the opening step, at least a part of the connecting portion is removed.

(4) In yet another preferred embodiment, in the method for producing a ceramic heater as described in (3) above, electrode lead-out portions which are electrically connected respectively to the lead portions are disposed on a side face of the ceramic heater. The method further comprises: a centerless polishing step of applying centerless polishing to the fired body; and a curved-surface polishing step of polishing a tip end portion which is one end side of the fired body, into a curved surface shape.

(5) In yet another preferred embodiment, in the method for producing a ceramic heater as described in (4) above, the electrode lead-out portions are integrally formed with the lead portions, respectively, and each of the electrode lead-out portions is exposed from a side face of the fired body by the centerless polishing step.

(6) In yet another preferred embodiment, in the method for producing a ceramic heater as described in (4) or (5) above, at least the heating portion is exposed by the centerless polishing step.

(7) In yet another preferred embodiment, in the method for producing a ceramic heater as described in any of (4) to (6) above, the connecting portion is formed on the other end side with respect to positions where the electrode lead-out portions are formed, in an elongated direction of the lead portions.

(8) The invention also relates to a ceramic heater produced by a method for producing a ceramic heater according to any one of (1) to (7) above.

(9) In a preferred embodiment, in the ceramic heater as described in (8) above, the ceramic heater comprises: a heating portion provided on a tip end side of a substrate containing an insulating ceramic; a pair of lead portions having one-ends connected to both electrodes of the heating portion, respectively, and other ends placed on a rear end side of the substrate; and electrode lead-out portions diverging from the pair of lead portions, respectively, and which elongate to a side face of the substrate.

(10) The invention also relates to a glow plug which comprises: a ceramic heater according to (8) or (9) above; a cylindrical member which surrounds the ceramic heater in a state where the other end side of the ceramic heater is exposed, and which holds the ceramic heater in a state where the cylindrical member is in contact with one of the pair of exposed electrode lead-out portions; a metal shell which holds the cylindrical member in a state where the metal shell is joined on a tip end side (of the metal shell) to a circumference of the cylindrical member, and the other end side of the ceramic heater is exposed; and an external terminal which is held in a state where the external terminal is electrically connected to another of the electrode lead-out portions, and the external terminal is insulated from the metal shell on a rear end side of the metal shell.

(11) The invention also relates to a ceramic heater comprising: a substrate containing an insulating ceramic; a heating portion provided on a tip end side of the substrate; a pair of lead portions having front ends connected to the heating portion and rear ends exposed from a rear end face of the substrate; and electrode lead-out portions diverging from the pair of lead portions, respectively, and extending to a side face of the substrate, wherein the rear ends of the lead portions are disconnected from each other by removing a connecting portion connecting them after firing.

In the method for producing a ceramic heater according to (1), the element green body having a first part that is to become a heating element after firing forms an annular portion. The element green body before firing is in a state of a ceramic powder that is compressed and packed, and hence is brittle. When an element green body is formed to have an annular portion, however, the structural brittleness is lessened or the structure is reinforced, and the handling of the element green body during the production process (specifically, the steps continuing to the firing step) is facilitated. The annular portion may be circular annular, rectangular annular, or semicircular(D-shaped)-annular. The whole element green body may be annular, or a part of the element green body may be annular. That is, when portions constituting the element green body are continuous so as to have an annular shape, a load due to applied weight can be dispersed so as not to be concentrated at a specific portion, at least not in the annular portion.

In the element green body, at least the portion that is to become a heating element contains a conductive ceramic. When the annular portion is opened by cutting or grinding a second part of the annular portion so as to become a non-annular portion (the first part of the annular portion) remained after the opening step of the method for producing a ceramic heater according to (2), the heating element formed after firing has no portion which is configured as an electrically closed circuit. Hence, there is no possibility of a short circuit. As a result, the heating element can function as a ceramic heater. Preferably, the opening step is conducted after the step of holding the element green body by the powder or green body of an insulating ceramic that is to become the substrate after firing. In this manner, the element green body is not handled alone.

The method for producing a ceramic heater according to (3) is a more specific configuration of the production method of (2). When the annular portion of the element green body is configured by the heating portion, the lead portions, and the connecting portion, the heating portion and the lead portions which are to become the heating element after firing can be handled in the process of producing the ceramic heater in a state where structural brittleness is lessened or the structure is reinforced. The connecting portion which is removed in the opening step is a portion which is connected in order to facilitate handling of the element green body. When this portion is set to a portion which least affects the heating of the ceramic heater, the initial performance and shape of the ceramic heater can be maintained.

In the holding step, the element green body can be held in a state where the element green body is embedded in the powder or green body of an insulating ceramic. Alternatively, the element green body may be completely embedded, or may be exposed in part or in whole. In a state where the heating portion of the heating element is exposed from the substrate, particularly, heat generated in the heating portion can be efficiently conducted to the surroundings of the ceramic heater. Therefore, this state is preferable. By contrast, when the element green body is completely embedded in the substrate, the heating element can be protected, and the life of the ceramic heater can be prolonged.

The method for producing a ceramic heater according to (4) concerns the shape of the outer surface of the fired body. Any one of the centerless polishing step in which the side face and thickness of the fired body are worked, and the curved-surface polishing step in which the shape of the tip end portion is worked can be first conducted, More preferably, the curved-surface polishing step is conducted after the centerless polishing step, whereby a portion of a side face of the ceramic heater adjacent to the tip end portion can be formed more accurately. As a result of the curved-surface polishing step, the distance between a heating resistor of the heating element incorporated in the tip end portion of the ceramic heater, and the surface of the tip end portion is shortened, to thereby efficiently conduct heat generated in the heating resistor.

In the method for producing a ceramic heater according to (5), each of the electrode lead-out portions can be exposed from a side face of the fired body by the centerless polishing step. Therefore, there is no need to either previously form a portion which is to become the electrode lead-out portion, or to process that portion.

In the method for producing a ceramic heater according to (6), the heating portion of the heating element can be exposed by the centerless polishing step. Exposure of the heating portion enables heat generated in the heating portion to be efficiently conducted to the surroundings of the ceramic heater.

In the method for producing a ceramic heater according to (7), the connecting portion where the portions that are to become the lead portions are connected to each other is formed on the side opposite to the heating resistor with respect to the electrode lead-out portions, i.e., in the rear end side of the ceramic heater. In the opening step, therefore, the connecting portion can be easily removed in a state where the electrode lead-out portions remain. Furthermore, a portion which may affect the energization and heat generation that are functions of a ceramic heater does not bear traces of the connection of the connecting portion, and influence due to the formation of the connecting portion can be eliminated.

The ceramic heater according to (8) can be produced using the above-described production method. Therefore, it is possible to realize a ceramic heater having fewer defects.

In the ceramic heater according to (9), the element green body is easily handled, and hardly broken as compared with a conventional heater. Therefore, the production yield of the ceramic heater can be improved.

The glow plug according to (10) comprises the ceramic heater according to (8) or (9), and hence the element green body is easily handled in the production process, and is hardly broken as compared with a conventional heater. Therefore, the production yield of the ceramic heater can be improved, and accordingly, the production yield of the glow plug can also be improved.

DESCRIPTION OF REFERENCE NUMBERS

Figure 1:
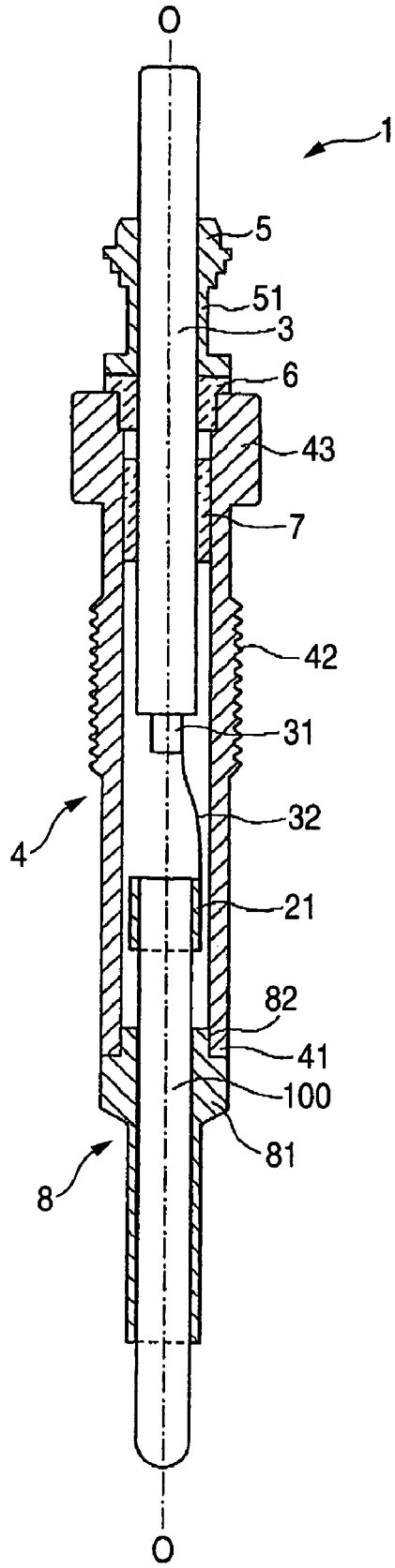
FIG. 1 is a longitudinal section view of a glow plug 1 of an embodiment of the invention.

Reference numbers used to identify various structural features in the drawings include the following.

1, 201 glow plug
3 center pole
4 metal shell
8 cylindrical member
100 ceramic heater
110 element green body
111 heating portion (green)
112 annular portion
115, 116 lead portion (green)
117, 118 electrode lead-out portion (green)
119 support portion
120 ceramic substrate (green)
125 ceramic substrate
130 element holding body
140 fired body
171 tip end portion
180, 280, 380, 480, 580 heating element
181, 281, 381, 481, 581 heating portion
185, 186, 285, 286, 385, 386, 485, 486, 585, 586 lead portion
187, 188, 287, 288, 387, 388, 487, 488 electrode lead-out portion

DETAILED DESCRIPTION OF THE INVENTION

Hereinafter, an embodiment of the method for producing a ceramic heater of the invention will be described by reference to the accompanying drawings. However, the present invention should not be construed as being limited thereto.

Figure 2:
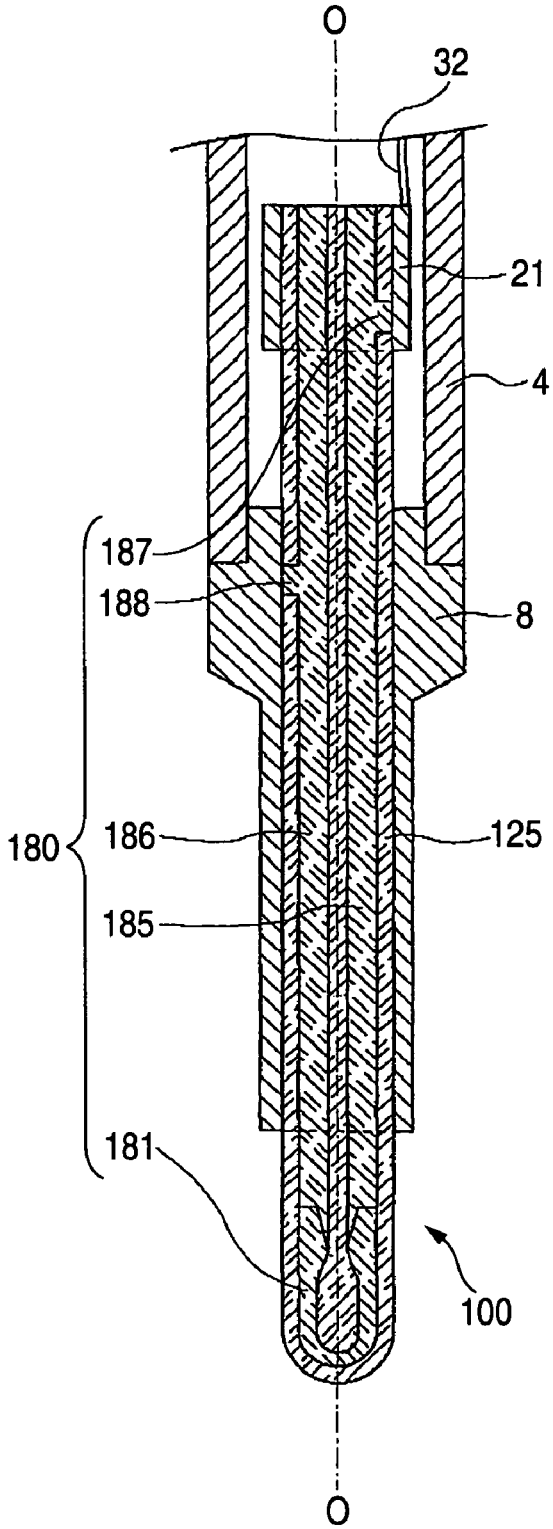
FIG. 2 is an enlarged sectional view of main portions in the vicinity of a ceramic heater 100 of the glow plug 1.

First, an example of a glow plug comprising a ceramic heater produced according to the invention will be described with reference to FIGS. 1 and 2. FIG. 1 is a longitudinal section view of a glow plug 1 of the embodiment. FIG. 2 is an enlarged section view of main portions in the vicinity of a ceramic heater 100 of the low plug 1. In FIGS. 1 and 2, the direction of the axis O of the glow plug 1 is the vertical direction in the drawings, the lower side is the tip end side of the glow plug 1, and the upper side is the rear end side.

As shown in FIG. 1, the glow plug 1 is configured such that ceramic heater 100 having a round-rod like shape and a center pole 3 that functions as an electrode lead out are juxtaposed with their axes aligned with the axis O, and a cylindrical metal shell 4 surrounds their circumferences.

The ceramic heater 100 has a heating element 180 (see FIG. 2) made of a fired conductive ceramic held in an embedded state inside a ceramic substrate 125. The ceramic substrate 125 is made of an insulating ceramic which has a round-rod like shape and which is fired, and has a tip end that is processed into a curved surface. A cylindrical member 8 surroundingly holds the outer circumference of a barrel portion of the ceramic heater 100. The cylindrical member 8 is configured by a metal member. A thick flange 81 is formed in the rear end side of the cylindrical member. The rear-end circumference of the flange 81 is formed as a step-like engaging portion 82. The inner circumference of a tip end portion 41 of the cylindrical metal shell 4 is engaged with the engaging portion 82. In the engagement, the axes of the ceramic heater 100 and the metal shell 4 coincide with the axis O. In this state, a portion of the ceramic heater 100 which is on the rear end side with respect to the cylindrical member 8 is housed inside the metal shell 4, and the metal shell 4 is positioned by the engaging portion 82 of the cylindrical member 8. Therefore, the rear end portion of the ceramic heater 100 is not in contact with the metal shell 4.

A male thread portion 42 for attaching the glow plug 1 to an engine head (not shown) of an internal combustion engine is formed substantially in the middle of the metal shell 4 in the direction of the axis O. A flange-like tool engagement portion 43 having a hexagonal section shape perpendicular to the direction of the axis O is formed on the outer circumference of the rear end of the metal shell 4. A tool used when the glow plug 1 is to be screwed to an engine head will be engaged with tool engagement portion 43.

The metal-made center pole 3 having a round-rod like shape is inserted to an approximately middle portion into the rear-end inner circumference of the metal shell 4. An annular insulating member 7 is disposed between the outer circumference of the center pole 3 and the inner circumference of the metal shell 4. The center pole 3 is fixed so that the axes of the center pole 3 and the metal shell 4 coincide with one another on the axis O. A flanged annular insulating member 6 is fitted into the rear end of the metal shell 4 so that a part of the member is interposed between the center pole 3 and the metal shell 4 in a state where the center pole 3 is passed through the member. On the rear end side of the insulating member 6, a cylindrical crimp member 5 is fitted onto the center pole 3. The outer circumference of a barrel portion 51 of the crimp member 5 is crimped in a state where the crimp member butts against the insulating member 6, so as to press the insulating member 6 fitted between the center pole 3 and the metal shell 4. This structure prevents the insulating member from slipping off from the center pole 3. The center pole 3 corresponds to the "external terminal" in the invention.

The tip end of the center pole 3 is formed as a small-diameter portion 31, and positioned substantially in the middle of the metal shell 4. An annular electrode ring 21 fitted onto the rear end of the ceramic heater 100, and the small-diameter portion 31 of the center pole 3 are electrically connected to one another by a lead wire 32.

Next, the ceramic heater 100 will be described in more detail. As described above, the ceramic heater 100 shown in FIG. 2 has a round-rod like ceramic substrate 125 which is formed by firing an insulating ceramic, which extends in the direction of the axis O, and which has a substantially uniform diameter. The heating element 180 which is formed by firing a conductive ceramic, and which has an approximately U-like section shape is held inside the substrate. The heating element 180 is mainly configured by a heating portion 181 which generates heat, and lead portions 185, 186 which are connected respectively to both electrodes of the heating portion 181 to supply electric power to the heating portion 181. The ceramic substrate 125 corresponds to the "substrate" in the invention.

The heating portion 181 is a portion which functions as a heating resistor. In the tip end side of the ceramic heater 100 that is formed into a curved surface, end portions that have an approximately U-like shape in accordance with the curved surface are folded back. The lead portions 185, 186 are connected respectively to the end portions of the heating portion 181, and extend in parallel along the axis O toward the rear end of the ceramic heater 100. An electrode lead-out portion 187 is protrudingly disposed at a position near the rear end of the lead portion 185, and exposed from the outer circumferential face of the ceramic heater 100. Similarly, an electrode lead-out portion 188 protrudes from the lead portion 186, and is exposed from the outer circumferential face of the ceramic heater 100. The electrode lead-out portion 188 is disposed at a position which is closer to the middle of the ceramic heater 100 than the electrode lead-out portion 187 in the direction of the axis O.

In the electrode lead-out portion 188, the portion which is exposed from the outer circumferential face of the ceramic heater 100 is in contact with the inner circumferential face of the cylindrical member 8 so as to electrically connect the cylindrical member 8 and the lead portion 186. The above-mentioned electrode ring 21 is fitted onto the exposed portion of the electrode lead-out portion 187, and the electrode lead-out portion 187 is in contact with the inner circumferential face of the electrode ring 21, thereby electrically connecting the electrode ring 21 and the lead portion 185. That is, the center pole 3 which is electrically connected to the electrode ring 21 via the lead wire 32, and the metal shell 4 which is engaged with the cylindrical member 8 so as to be electrically connected thereto, function as an anode or a cathode for energizing the heating portion 181 of the ceramic heater 100.

In this embodiment, the ceramic substrate 125 is made of silicon nitride ($Si_3N_4$), and the heating element 180 is made of a conductive ceramic which essentially comprises silicon nitride to which 20 vol % of tungsten carbide (WC) is added. The heating portion 181 is molded in such manner that it has a sectional area smaller than that of the lead portions 185, 186. Consequently, in energization, heat generation occurs mainly in the heating portion 181, so that the heating portion 181 functions as a heating resistor, The materials of the heating portion 181 and the lead portions 185, 186 are different from one another so that the lead portions 385, 186 may have a higher conductivity than the heating portion 181.

In production of the thus configured ceramic heater 100 of the glow plug 1, in this embodiment, the following production method is used to facilitate the handling of an element green body 110 from which the heating element 180 is produced. Hereinafter, the method for producing the ceramic heater 100 will be described with reference to FIGS. 3 to 10.

Figure 3:
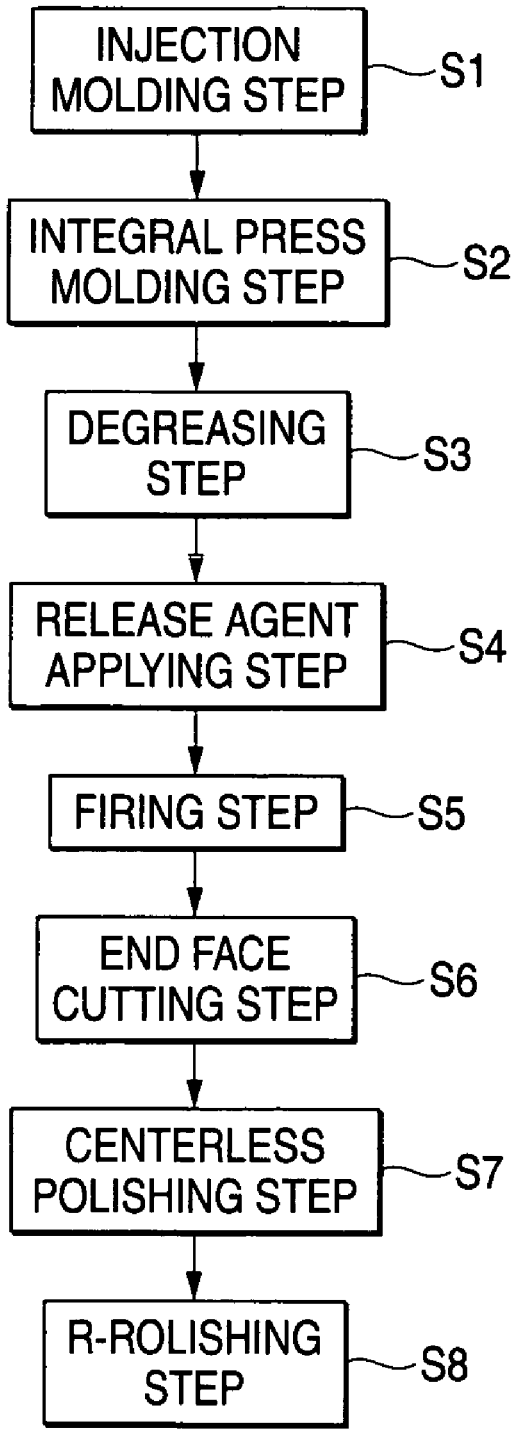
FIG. 3 is a flowchart showing steps of producing the ceramic heater 100.
Figure 4:
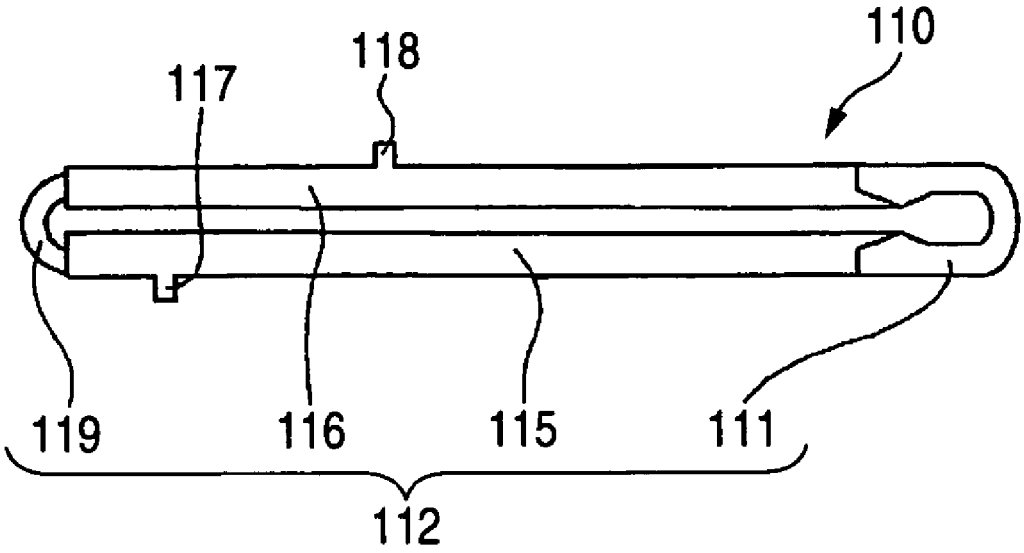
FIG. 4 is a plan view of an element green body 110 produced in an injection molding step.
Figure 5:
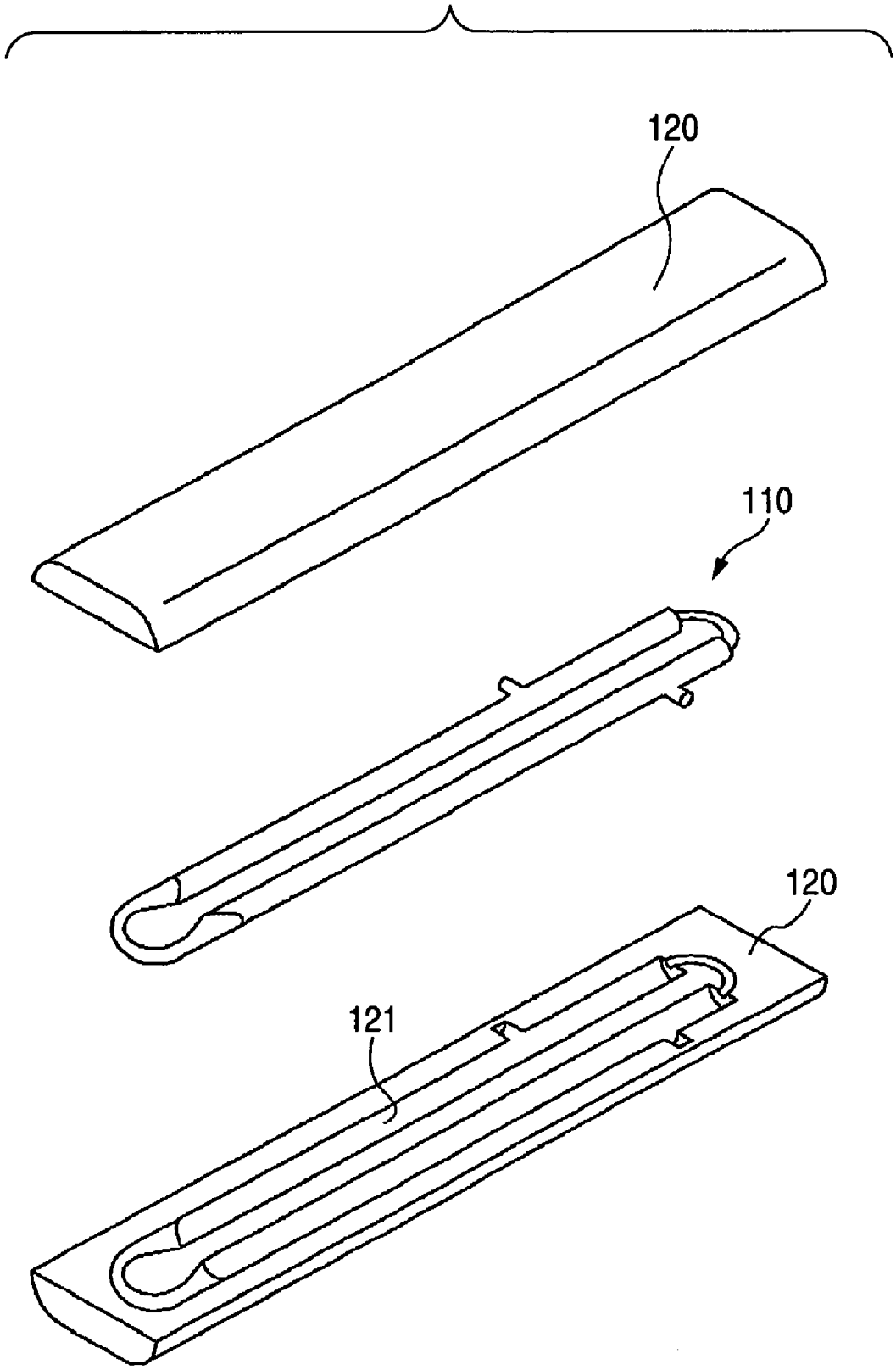
FIG. 5 is a perspective view showing a ceramic substrate 120 and the element green body 110 before they are integrated with one another by a pressing process in an integral press molding step.
Figure 6:
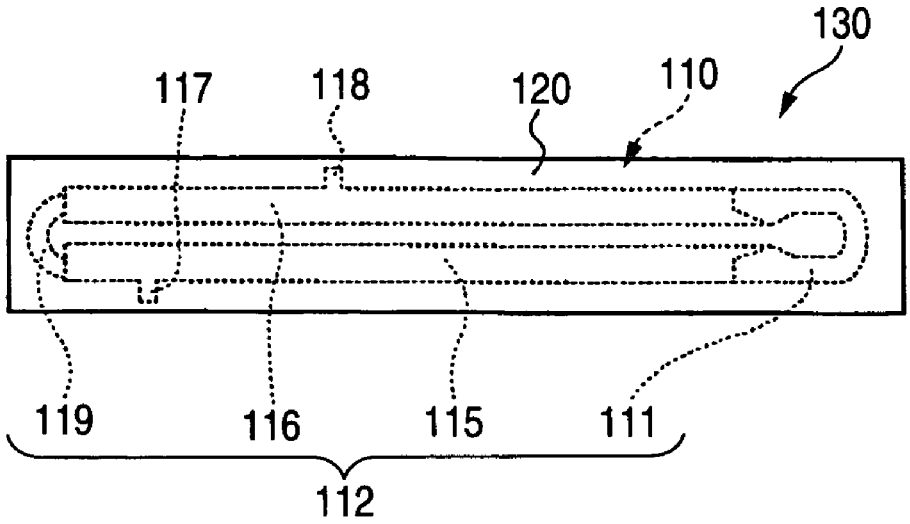
FIG. 6 is a plan view of an element holding body 130 in which the ceramic substrate 120 holds the element green body 110, the element green body 110 being integrated with the ceramic substrate 120 by the pressing process in the integral press molding step.
Figure 7:
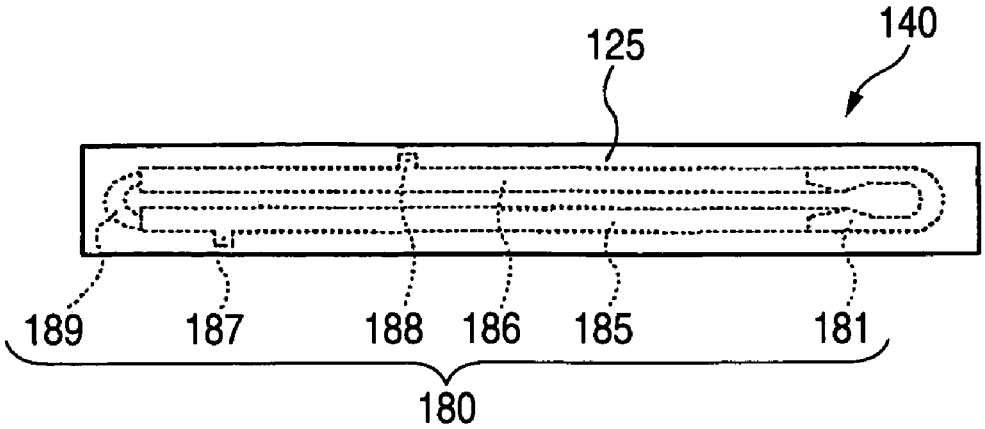
FIG. 7 is a plan view of a fired body 140 showing a ceramic substrate 125 and a heating element 180 which are fired in a firing step.
Figure 8:
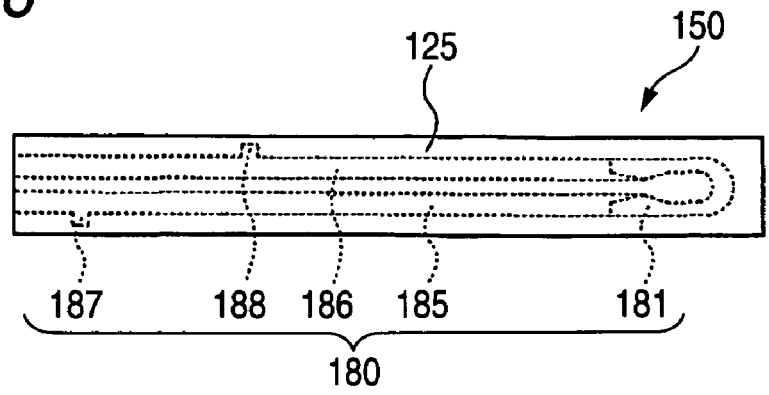
FIG. 8 is a plan view of a cut body 150 which is cut off in an end face cutting step, and in which an annular portion 112 shown in FIG. 6 is opened, showing the ceramic substrate 125 and the heating element 180.
Figure 9:
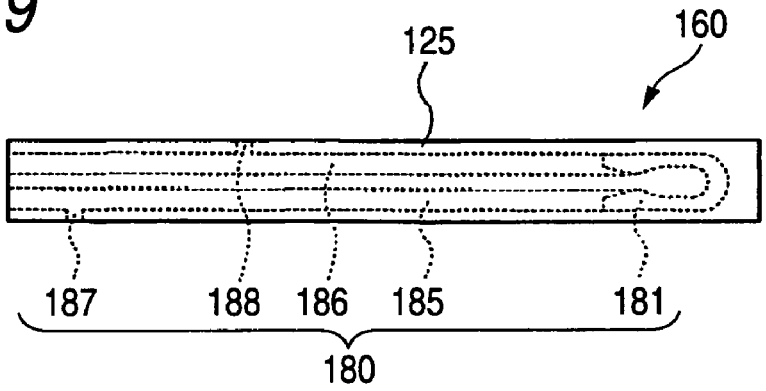
FIG. 9 is a plan view of a centerless polished body 160 showing the ceramic substrate 125 and the heating element 180 after centerless polishing in a centerless polishing step.
Figure 10:
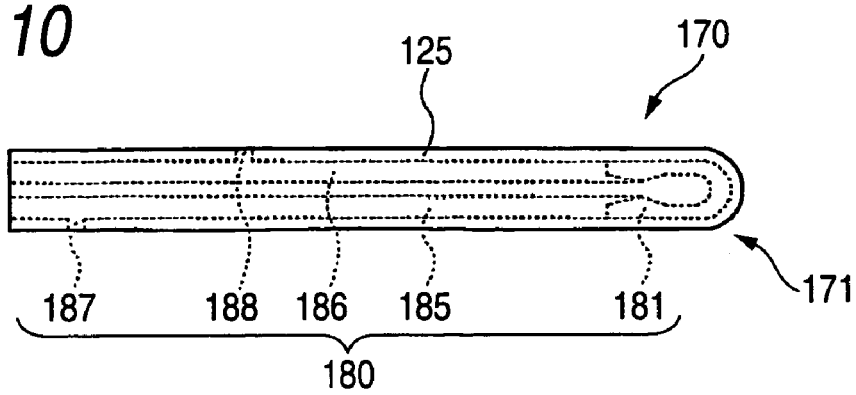
FIG. 10 is a plan view of an R-polished body 170 showing the ceramic substrate 125 and the heating element 180 after R-polishing in an R-polishing step.

FIG. 3 is a flowchart showing steps of producing the ceramic heater 100. FIG. 4 is a plan view of the element green body 110 produced in an injection molding step. FIG. 5 is a perspective view showing a ceramic substrate 120 and the element green body 110 before they are integrated with each other by a pressing process in an integral press molding step. FIG. 6 is a plan view of an element holding body 130 in which the ceramic substrate 120 holds the element green body 110 so as to become integrated therewith by pressing in the integral press molding step. FIG. 7 is a plan view of a fired body 140 showing a ceramic substrate 125 and the heating element 180 which are fired in a firing step. FIG. 8 is a plan view of a cut body 150 which is cut in an end face cutting step, and in which an annular portion 112 is opened, showing the ceramic substrate 125 and the heating element 180. FIG. 9 is a plan view of a centerless polished body 160 showing the ceramic substrate 125 and the heating element 180 after centerless polishing in a centerless polishing step. FIG. 10 is a plan view of an R-polished body 170 showing the ceramic substrate 125 and the heating element 180 after R-polishing in an R-polishing step. Hereinafter, the steps of the flowchart are indicated by "S".

In the production process of the ceramic heater 100, as shown in the flow chart of FIG. 3, an element green body 110 is first produced. The element green body 110 is produced by injection molding using, as a material raw powder, a conductive ceramic to which an additive agent such as a binder is added (S1). The injection molding step S1 corresponds to the "molding step" in the invention.

As shown in FIG. 4, the molded element green body 110 has a shape in which green lead portions 115, 116 connected respectively to both electrodes of a green heating portion 111 having an approximately U-like shape are positioned parallel to one another, and a green support portion 119 connecting the lead portions 115, 116 to one another at their terminals is formed. The support portion 119 is formed so as to have a section which is smaller than the sections of the lead portions 115, 116. The portions of the lead portions 185, 186 which extend from the electrode lead-out portion 187 to the support portion 119 are formed so as to have slightly elongated distances in the direction of the axis O. Before firing, a ceramic has weak mechanical strength. In this embodiment, therefore, the support portion 119 is disposed, and the annular portion 112 is formed by the heating portion 111, the lead portions 115, 116, and the support portion 119, whereby a load due to the weights of the lead portions 115, 116 is dispersed to the heating portion 111 and the support portion 119. As described above. the support portion 119 is formed so as to have a section which is smaller than the sections of the lead portions 115, 116. In this case, when the ceramic substrate 125 (see FIG. 8) is ground from the rear end side to open the annular portion 112 in the end face cutting step (S6) which will be described below, the annular portion can be sufficiently opened even if the grinding amount is set relatively small. However, it is not always necessary to form the support portion 119 so as to have a smaller section. The support portion may be formed so as to have the same thickness as the lead portions 115, 116, or formed so as to be thicker than the lead portions 115, 116. The support portion 119 corresponds to "connecting portion" in the invention.

Although not illustrated, in a powder molding step which is different from the injection molding step, an injection molding process is conducted using, as a material raw powder, an insulating ceramic to which an additive agent such as a binder is added, thereby producing the green ceramic substrate 120. As shown in FIG. 5, the ceramic substrate 120 is molded into a pair of flat plates in the form of a half-split green body, and recesses 121 for housing the element green body 110 are formed in mating faces. In outer side faces of the ceramic substrate 120 which are opposite the mating faces, edges extending in the longitudinal direction may be chamfered, thereby forming the outer side faces into curved faces. The ceramic substrate 120 corresponds to the "green body of an insulating ceramic" in the invention.

After the element green body 110 and the ceramic substrate 120 are formed, as shown in FIG. 3, the integral press molding step is conducted (S2). In this step, as shown in FIG. 5, the element green body 110 is housed in the recess 121 of one of the split halves of the ceramic substrate 120, and then covered by the mating other split half of the ceramic substrate 120. Then, a pressing machine (not shown) applies pressing force on the ceramic substrate to form the element holding body 130 in which the element green body 110 is held and integrated with the ceramic substrate 120 in an embedded state. The pressing machine conducts pressing using dies. In the dies, a recess is formed so that the sectional shape of the formed element holding body 130 is an approximately oval shape in which the major axis coincides with the mating line of the split halves of the ceramic substrate 120. The integral press molding step S2 corresponds to the "holding step" in the invention.

In the next step, i.e., a degreasing step, a process of removing binder contained in the ceramic is conducted (S3). In this debinding process, the element holding body 130 is treated at 800° C. for 1 hour in a nitrogen atmosphere. A release agent applying step is then conducted to apply a release agent to the whole outer surface of the element holding body 130 (S4).

Next, the firing step is conducted (S5). In this step, the ceramic is fired by a known hot pressing method. That is, dies in which the shape to be formed as the ceramic heater is recessed are used, and a pressurizing and heating process in a non-oxidizing atmosphere is conducted at 1,800° C. for 1 hour under a hot pressing pressure of 300 kgf/cm$^2$, whereby the fired body 140 shown in FIG. 7 is produced. At this time, a hot pressing machine is used to conduct a hot pressing process using dies in which a recess for correcting the shape is formed so that the fired element holding body 130 has an approximately columnar shape. The element holding body 130 is set in the recesses of the dies so that the direction of the major axis of the approximately oval shape of the axial section (i.e., the mating line of the ceramic substrate 120) coincides with the press direction (compression direction), and fired while being pressed. The formed fired body 140 has a shape which is obtained by compressing and deforming by hot pressing the shape of the element holding body 130 before firing, and adapting the shape to the recesses of the dies. In this embodiment, the fired body is produced into a round-rod like shape having an approximately uniform section perpendicular to an axial direction.

Then, the end face cutting step of cutting away the rear end side of the fired body 140 is conducted (S6). In this step, as shown in FIG. 8, the rear end side of the fired body 140 is cut off in a section perpendicular to an axial direction to remove a support portion 189 (see FIG. 7) held on the fired ceramic substrate 125, thereby obtaining the cut body 150 in which the lead portions 185, 186 are exposed at an end face. The cutting process is conducted in order to prevent the lead portions 185, 186 of the heating element 180 from short circuiting without passing through the heating portion 181. The cut position is selected so as to be on the rear end side (the side of the support portion 189) with respect to the electrode lead-out portion 187, and the portion to be removed may include a part of the lead portions 185, 186. As a result, the annular portion 112 of the element green body 110 which is configured in the injection molding step by the heating portion 111, the lead portions 115, 116, and the support portion 119 is opened so as to become a non-annular portion. The cutting process is conducted using, for example, a known diamond cutter. The support portion 189 may be removed by cutting the rear end side. The end face cutting step corresponds to the "opening step" in the invention.

Next, a centerless polishing step is conducted (S7). In this step, a known centerless polishing machine is used to polish the outer circumference of the cut body 150. As shown in FIG. 9, the electrode lead-out portions 187, 188 are exposed at an outer circumferential face. In this manner, a centerless polished body 160 is obtained.

Furthermore, an R(Rounding)-polishing step is conducted (S8). In this step, as shown in FIG. 10, a tip end portion 171 of the centerless polished body 160 is polished to obtain the R-polished body 170 which is processed to have a curved surface, i.e., the completed ceramic heater 100. The heating portion 181 of the heating element 180 is held by the tip end portion 171. As a result of the R-polishing process, a curved face is ground which extends along the outer side face of the heating portion 181 and has an approximately U-like sectional shape. Therefore, the distance between the heating portion 181 and the outer face of the tip end portion 171 is substantially uniform in accordance with the shape of the heating portion 181, and is shorter. Consequently, heat generated in the heating portion 181 can be efficiently conducted to the outside. The R-polishing step of S8 corresponds to the "curved-surface polishing step" in the invention.

The thus produced ceramic heater 100 is pressingly inserted into the cylindrical member 8, and the electrode lead-out portion 188 which is exposed by the centerless polishing step is electrically connected with the cylindrical member. Similarly, the rear end of the ceramic heater 100 is pressingly inserted into the electrode ring 21, and the electrode lead-out portion 187 is electrically connected with the ring. As described above, the ceramic heater 100 is incorporated into the metal shell 4, and the electrodes are electrically connected thereby completing the glow plug 1.

It is a matter of course that the invention may be variously modified. For example, the sectional shape of the element green body 110 shown in FIG. 5 may be circular, rectangular, or polygonal. In the pair of green halves of the ceramic substrate 120, only one of the halves may be configured to have the recess 121 in which the element green body 110 is housed. Alternatively, the recess 121 may not be formed. The ceramic substrate 120 need not be formed as a pair of planar members. In the embodiment, the ceramic substrate 120 is formed as a pair of planar halves in the injection molding step, and the pressing process in the integral press molding step is applied such that the element green body 110 is sandwiched between the pair of halves of the ceramic substrate 120. The two steps may be combined to be simplified as successive steps. That is, a half-split green body of the ceramic substrate 120 is injection molded in the powder molding step, and, in a similar manner as the embodiment, the element green body 110 is injection molded in the injection molding step. In the integral press molding step, then, the element green body 110 is set in the recess 121 of the split half of the ceramic substrate 120. Next, a raw material powder of the insulating ceramic is loaded to form the other split half of the ceramic substrate 120. When a pressing process is applied in this state, it is possible to obtain an element holding body 130 which is similar to the embodiment. Alternatively, the powder molding step may be omitted, and the element holding body 130 may be obtained by: charging a raw material powder of the insulating ceramic for forming a split half of the ceramic substrate 120 into a molding die in the integral press molding step; placing the element green body 110 on the powder; and, in a similar manner as described above, conducting a pressing process after a raw material powder of the insulating ceramic for forming the other split half of the ceramic substrate 120 is loaded. In other words, the element holding body 130 may be produced by known production methods, without particular limitation as long as the previously produced element green body 110 is placed so as to be held by the ceramic substrate 120, and the element holding body 130 can be obtained by pressing.

The end face cutting step is conducted after the firing step, and before the centerless polishing step. Alternatively, the end face cutting step may be conducted after any step as long as the integral press molding step (holding step) is previously conducted.

Figure 11:
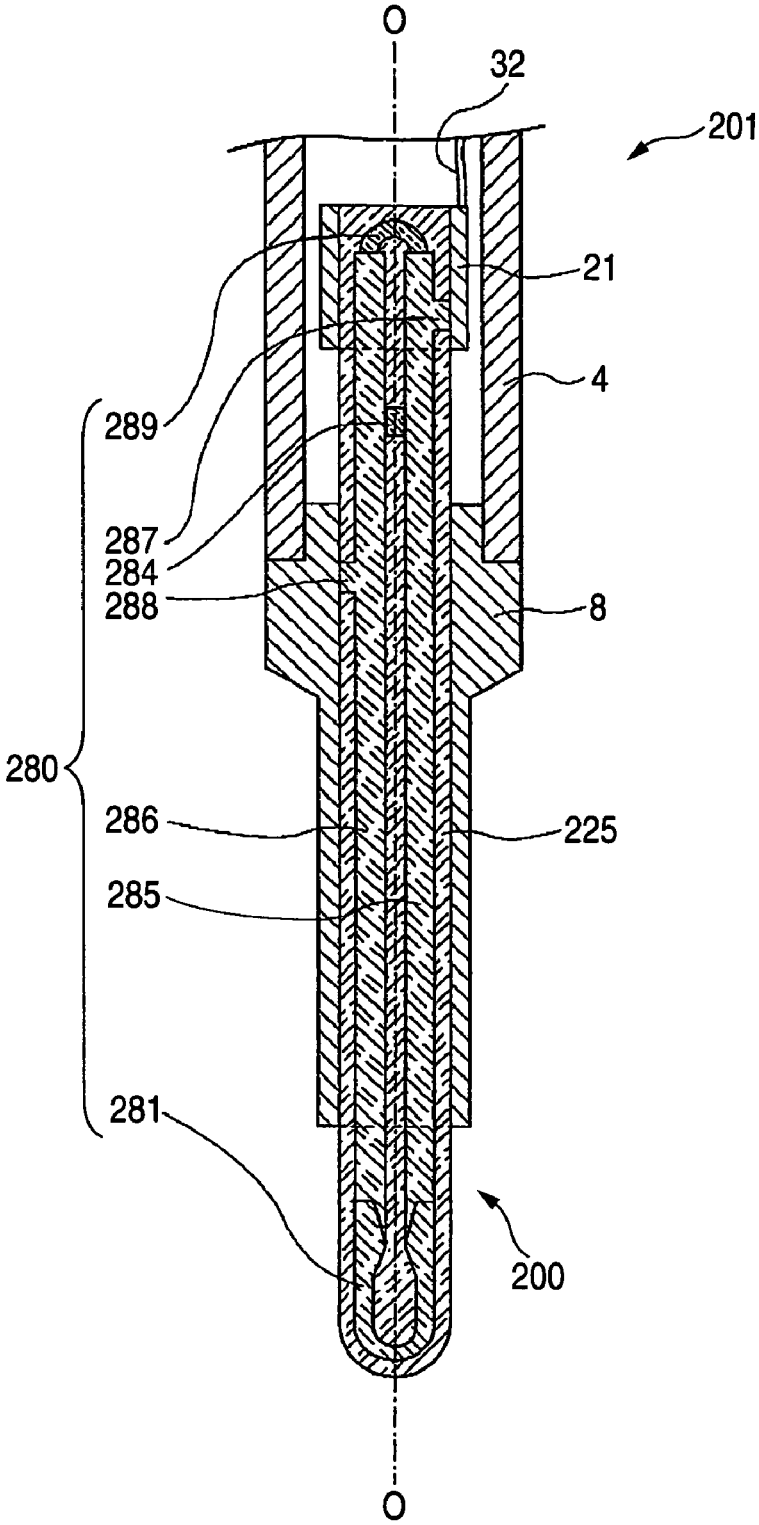
FIG. 11 is an enlarged sectional view of main portions of a glow plug showing the configuration of a ceramic heater 200 which is a modification of the embodiment.

In the embodiment, during the process of producing the element green body 110, the support portion 119 is disposed so as to connect the edge ends of the lead portions 115, 116 to one another. Alternatively, the support portion may be formed in an arbitrary portion as long as it is on the rear end side in the direction of the axis O with respect to the heating portion 111 (the side opposite that where the heating portion 111 is placed), more preferably on the side of the rear end with respect to the positions where the electrode lead-out portions 117, 118 are disposed. In the end face cutting step, however, the support portion 119 is removed or electrically disconnected. In contrast, when the fired support portion 189 is not electrically conductive upon completion of the ceramic heater 100, the support portion need not be removed. In forming the element green body 110 shown in FIG. 4, for example, the element green body is integrally formed by two ceramics of different materials. That is, the heating portion 111 and the lead portions 115, 116 are formed from a conductive ceramic, and the support portion 119 is formed from an insulating ceramic. In the case where a ceramic heater 200 shown in FIG. 11 is produced using the thus formed element green body, even when the end face cutting step (opening step) is omitted and a fired support portion 289 is not removed, a short circuit between fired lead portions 285, 286 through the support portion 289 does not occur. This is because the support portion 119 is formed from an insulating ceramic. The support portion 289 may be held such that the support portion is embedded in a ceramic substrate 225 as shown in FIG. 11, or exposed outside the ceramic substrate 225.

When such insulating members are used, a portion which is to become a support portion 284 that bridges between the lead portions 285, 286 after firing may be formed as shown in FIG. 11, thereby dispersing a load due to the weights of the portions of the green element green body. In the case where such portion which is to become the support portion 284 is formed, the support portion 119 (see FIG. 4) which connects the lead portions 115, 116 to one another at their terminals need not be formed.

Figure 12:
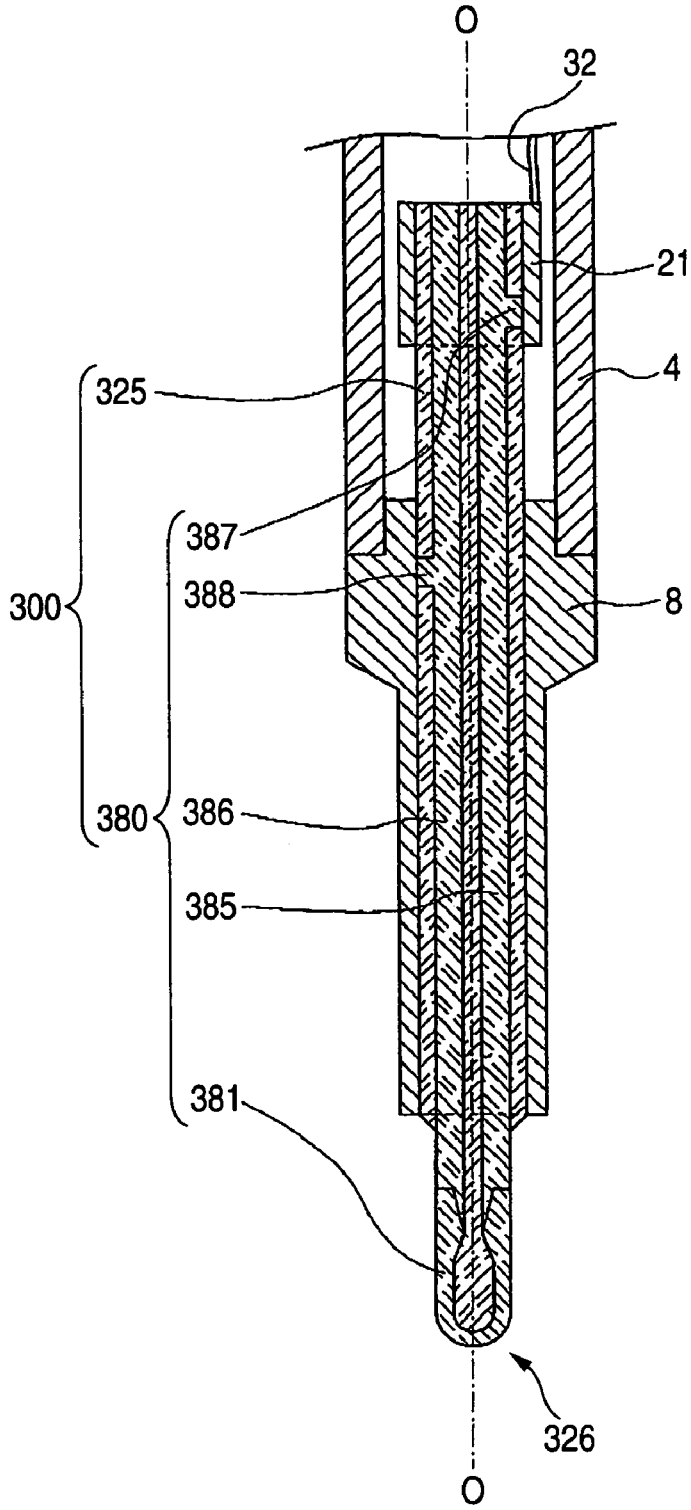
FIG. 12 is an enlarged sectional view of main portions of a glow plug showing the configuration of a ceramic heater 300 which is a modification of the embodiment.

The ceramic heater 100 may be configured such that the heating element 180 is exposed from the outer circumferential face. According to this configuration, heat generated in the heating portion 181 is directly conducted outside of the ceramic heater 100 without passing through the ceramic substrate 125. Since the heating element 180 is made of a conductive ceramic, the following configuration may be employed. As in a ceramic heater 300 shown in FIG. 12, for example, a tip end portion 326 of a ceramic substrate 325 which corresponds to the vicinity of the placement position of a heating portion 381 is reduced in diameter, and the face of the outer circumference of a heating element 380 is continuous with the outer circumferential face of the ceramic substrate 325. In order to configure the ceramic heater 300 in this manner, a tip end portion of the ceramic heater which has been polished in the centerless polishing step in the same manner as the embodiment is further polished to expose the heating element 380. Alternatively, in the case where a green ceramic substrate (not shown) is to be produced, a tip end portion of the ceramic substrate may be previously formed so as to coincide in size and shape with a green element green body (not shown), and, in a state of an element holding body (not shown) in which the element green body and the ceramic substrate are integrated, they may form a continuous outer surface. Alternatively, the sectional shape of the element green body is preferably made rectangular. In this case, even when the element green body is sandwiched between a pair of split halves of the ceramic substrate, a gap between the ceramic substrate and the element green body is hardly formed in a portion where the element green body is exposed.

Figure 13:
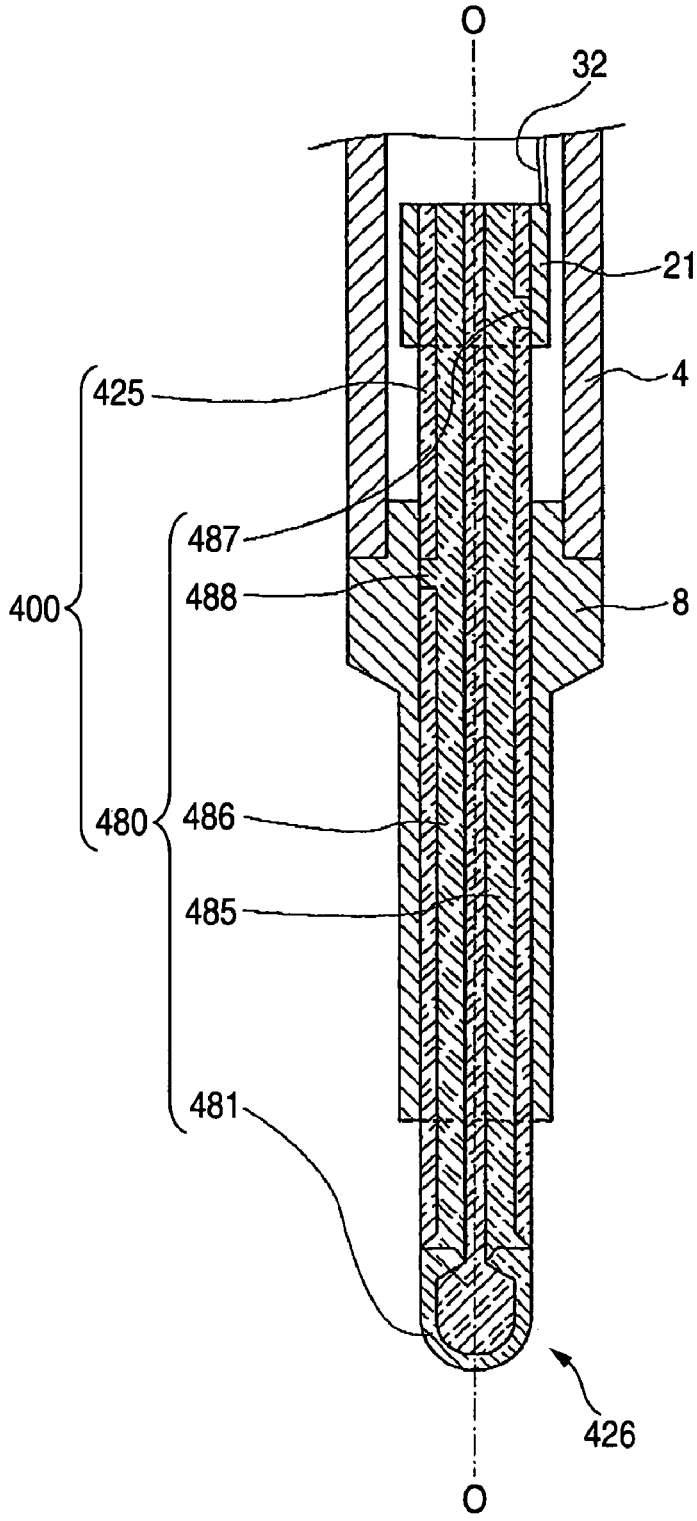
FIG. 13 is an enlarged sectional view of main portions of a glow plug showing the configuration of a ceramic heater 400 which is a modification of the embodiment.

In the ceramic heater 400 shown in FIG. 13, the size and shape of a heating element 480 are enlarged as compared with the heating element 180 of the embodiment to coincide with the size and shape of a ceramic substrate 425. In this manner, the outer circumferential face of the heating element 480 is continuous with that of a tip end portion 426 of the ceramic substrate 425 in the vicinity of a placement position of a heating portion 481.

Figure 14:
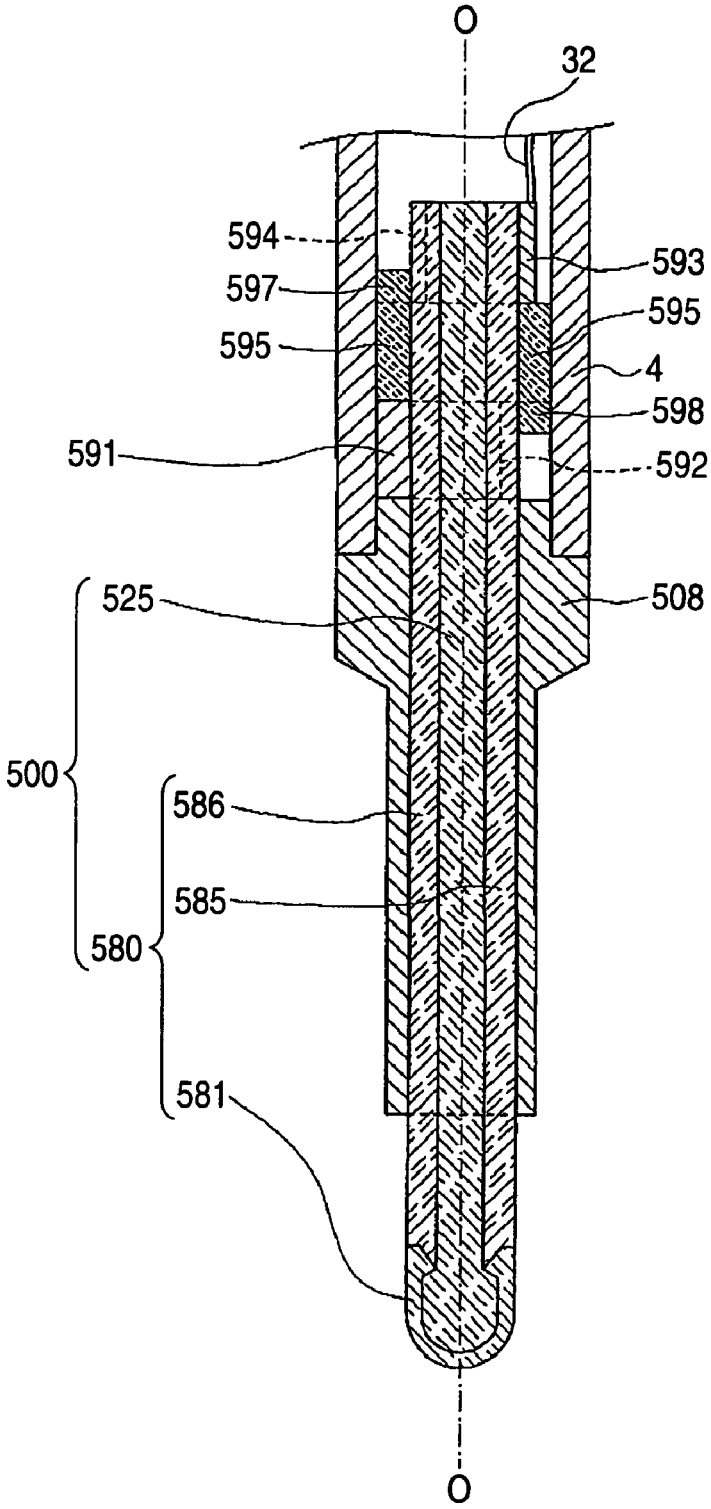
FIG. 14 is an enlarged sectional view of main portions of a glow plug showing the configuration of a ceramic heater 500 which is a modification of the embodiment.

In the ceramic heater 500 shown in FIG. 14, the outer circumferential face of a heating element 580 including lead portions 585, 586 may be continuous with that of a ceramic substrate 525. According to this configuration, the shape of an element green body (not shown) which is to become the heating element 580 after firing can be simplified. That is, the element green body can have a configuration in which the electrode lead-out portions 117, 118 are omitted from the element green body 110 of the embodiment. Furthermore, the shape of the fired body which is held on the ceramic substrate and fired can be formed as a straight round rod-like shape, and the centerless polishing process can be easily conducted. On the other hand, the heating element 580 made of a conductive ceramic is exposed outside of the ceramic heater 500. Therefore, a C-like ring or the like may be used for leading out an electrode, and cylindrical member 508 may be formed by an insulating material.

Figure 15:
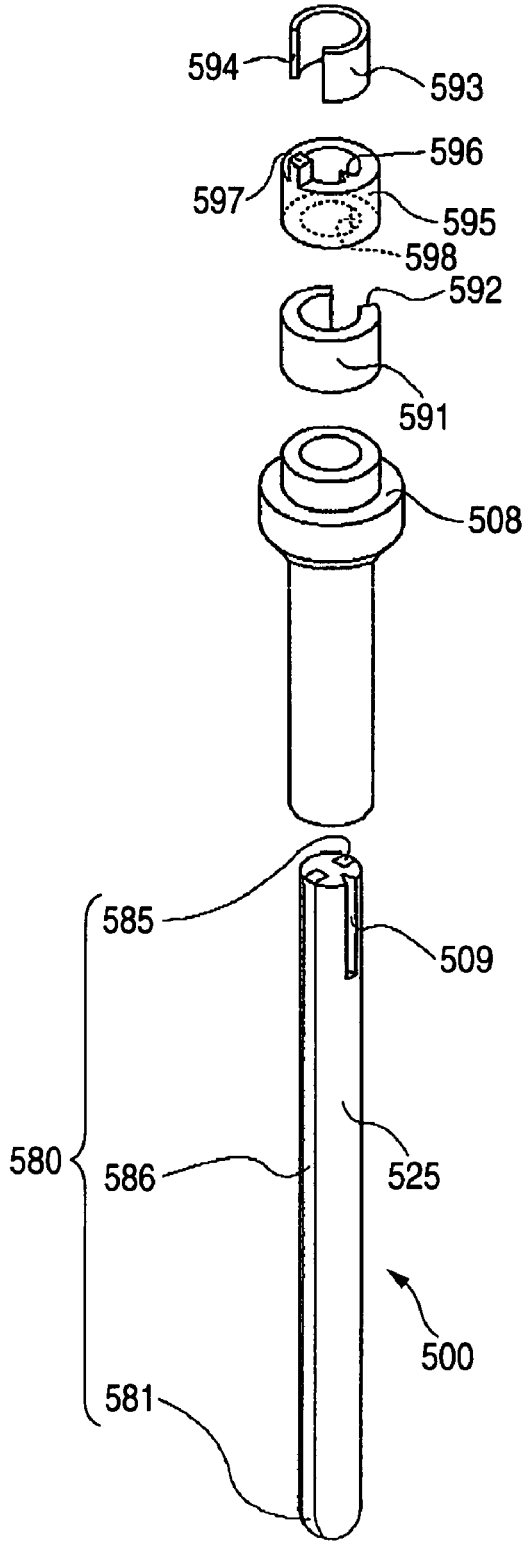
FIG. 15 is a perspective view illustrating a configuration for leading out electrodes from the ceramic heater 500.

As shown in FIGS. 14 and 15, for example, a C-like ring 591 for electrically connecting the lead portion 586 with the metal shell 4 is engaged with a barrel portion of the ceramic heater 500, and at this time an open portion 592 of the ring 591 is placed at the position of the lead portion 585 so that the lead portion 585 and the ring 591 are not electrically connected to one another. Similarly, a C-like ring 593 for electrically connecting the lead portion 585 with the lead wire 32 is engaged with the ceramic heater 500 so that an open portion 594 is placed at the position of the lead portion 586. The ring 593 is configured to have a small outer diameter so as not to be in contact with the inner circumferential face of the metal shell 4. By contrast, the ring 591 is configured to have a large outer diameter so as to be in contact with the inner circumferential face of the metal shell 4. An insulation spacer 595 is disposed between the rings 591 and 593, so that the rings are not electrically connected to one another. A projection 596 which engages with a groove 509 formed in the barrel portion of the ceramic heater 500 may be formed on the inner circumferential face of the insulation spacer 595, so as to position the insulation spacer 595 with respect to the ceramic heater 500. Furthermore, a projection 597 may be disposed at a position which is on an end face of the insulation spacer 595 oh the side where the ring 593 is placed, and which corresponds to the lead portion 586. Also, a projection 598 may be disposed at a position which is on an end face on the side where the ring 591 is placed, and which corresponds to the lead portion 585. Accordingly, the open portions 594, 592 of the rings 593, 591 butt against the projections 597, 598 respectively. Therefore, the positional displacements of the rings 593, 591 with respect to the ceramic heater 500 can be regulated, so as to present the rings from electrically connecting to the lead portions 586, 585, respectively.

Instead of disposing electrode lead-out portions 187, 188, the electrical connections to the metal shell 4 and the center pole 3, as electrodes, may be made using parts of the lead portions 185, 186 which are exposed as a result of cutting off the rear end side of the ceramic heater 100 in the end face cutting step.

After the centerless polishing step or the R-polishing step, the outer circumference of the tip end side of the ceramic heater 100 is further polished to a tapered shape. According to this configuration, when the ceramic heater 100 is pressingly inserted into the cylindrical member 8, the insertion pressure is hardly applied to the tip end portion of the ceramic heater 100. This prevents the tip end portion can be from being damaged.

The ceramic heater 100 of the embodiment has a round rod-like shape, i.e., a circular axial section shape. The shape is not so restricted, and may be oval, square, or rectangular, or have an arbitrary polygonal shape.

In the specification, "heating portion," "lead portion," "electrode lead-out portion," and "connecting portion" refer to their corresponding portions, respectively, but this does not necessarily require the subject portions to be present as independent members. In the ceramic heater, for example, "heating portion" indicates a part including a highest-temperature portion, and, in the element green body, indicates a part which is called the "heating portion" when the ceramic heater is completed. The language "a connecting portion which connects the lead portions together on a side of other ends with respect to the heating portion" means that the connecting portion is disposed at a position which is separate from the heating portion. When the heating portion and the connecting portion in each of which the two lead portions are connected together are too close to one another, there is only a small degree of improvement in the structural brittleness of the element green body. When the connecting portion is formed in the ends of the lead portions which are opposite to the heating portion, however, there is a large degree of improvement in structural brittleness (i.e., lessening of structured brittleness).

The invention can be applied to a method for producing a ceramic heater for use in a glow plug for assisting start of a diesel engine, an ignition heater such as a burner, a heater for heating a gas sensor, and the like, a ceramic heater produced by the production method, a glow plug and various heaters comprising the ceramic heater.

It should further be apparent to those skilled in the art that the various changes in form and detail of the invention as shown and described above may be made. It is intended that such changes be included within the spirit and scope of the claims appended hereto.

This application is based on Japanese Patent Application No. 2004-188839 filed Jun. 25, 2004, the entire content of which is hereby incorporated by reference, the same as if set forth at length.

What is claimed is:

1. A method for producing a ceramic heater in which firing is conducted in a state where an element green body in which at least a portion containing a conductive ceramic that is to become a heating element after firing is integrated with a powder or green body of an insulating ceramic that is to become a substrate after firing, said ceramic heater comprising said substrate and said heating element, wherein said method comprises:

molding an element green body having an annular portion;

integrating said element green body with said powder or green body of an insulating ceramic, to form an integrated element holding body; and firing said integrated element holding body to form a fired body so that a first part of said annular portion becomes said heating element, wherein the molding step comprises forming said element green body, including said first part, from a powder of a conductive ceramic by injection molding, and said method further comprises, after the integrating step, cutting or grinding the integrated element holding body to open a second part of the annular portion so that the heating element remains, wherein said ceramic heater is a rod-shaped ceramic heater, in said molding step, said element green body having said annular portion comprises: two lead portions disposed along a longitudinal direction of said ceramic heater; said first part which connects one-end sides of said lead portions togvther; and a connecting portion which connects said lead portions together on a side of other ends with respect to said heating portion, said opening step comprises removing at least a part of said fired body so that a rear end face of said fired body is formed and removing at least a part of said connecting portion, and wherein said connecting portion has an approximately U-shape.

2. The method as claimed in claim 1, wherein electrode lead-out portions which are electrically connected respectively to said lead portions are disposed on a side face of said ceramic heater, said method further comprises:

centerless polishing said fired body; and curved-surface polishing a tip end portion of said fired body, into a surface having a curved shape.

3. The method as claimed in claim 2, wherein said electrode lead-out portions are integrally formed with said lead portions, respectively, and each of said electrode lead-out portions is exposed from a side face of said fired body by said centerless polishing.

4. The method as claimed in claim 2, wherein at least said heating portion is exposed by said centerless polishing.

5. The method as claimed in claim 2, wherein said connecting portion is formed on another end side with respect to positions where said electrode lead-out portions are formed, in an elongated direction of said lead portions.

6. The method as claimed in claim 1, wherein the heating element has an approximately U-shape.

7. The method as claimed in claim 1, wherein said integrating comprises integral press molding.

8. The method as claimed in claim 1, wherein the two lead portions have a higher electrical conductivity than the heating element.

9. A method for producing a ceramic heater in which firing is conducted in a state where an element green body in which at least a portion containing a conductive ceramic that is to become a heating element after firing is integrated with a powder or green body of an insulating ceramic that is to become a substrate after firing, said ceramic heater comprising said substrate and said heating element, wherein said method comprises:

molding an element green body having an annular portion including two lead portions disposed along a longitudinal direction of said ceramic heater; a first part which connects front ends of said lead portions together; and a connecting portion which connects rear ends of said lead portions together;

embedding said element green body in said powder or green body of an insulating ceramic, to form an integrated element holding body;

firing said element holding body to form a fired body so that said first part of said annular portion becomes said heating element; and removing said connecting portion and a part of said fired body so that a rear end face of said fired body is formed, from which said rear ends of said two lead portions are exposed.

10. The method as claimed in claim 9, wherein said removing comprises cutting or grinding the integrated element holding body.

11. The method as claimed in claim 9, wherein the two lead portions have a higher electrical conductivity than the heating element.

* * * * *